US007172547B2

(12) United States Patent
Lange

(10) Patent No.: US 7,172,547 B2
(45) Date of Patent: Feb. 6, 2007

(54) VARIABLE-CIRCUMFERENCE FOLDER

(75) Inventor: Klaus-Ulrich Lange, Gersthofen (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 10/295,208

(22) Filed: Nov. 15, 2002

(65) Prior Publication Data

US 2003/0096688 A1 May 22, 2003

(30) Foreign Application Priority Data

Nov. 17, 2001 (DE) ..... 101 56 706

(51) Int. Cl.
*B31F 1/10* (2006.01)

(52) U.S. Cl. ..... 493/428; 493/424; 493/434; 493/442

(58) Field of Classification Search ..... 270/49, 270/50; 493/424, 434, 442, 427, 428, 39, 493/45, 46, 47, 50
See application file for complete search history.

(56) References Cited

U.S. PATENT DOCUMENTS

| | | | | |
|---|---|---|---|---|
| 4,079,928 | A * | 3/1978 | Weschenfelder et al. | 270/4 |
| 4,094,499 | A | 6/1978 | Thomas | |
| 4,279,410 | A * | 7/1981 | Bolza-Schunemann | 270/6 |
| 4,391,596 | A * | 7/1983 | Fischer | 493/425 |
| 4,491,310 | A * | 1/1985 | Reffert | 270/49 |
| 4,564,183 | A | 1/1986 | Müller | 270/21.1 |
| 4,957,280 | A * | 9/1990 | Motooka | 270/47 |
| 5,072,919 | A * | 12/1991 | Schneider et al. | 270/49 |
| 5,386,979 | A * | 2/1995 | Muller | 270/42 |
| 5,494,270 | A * | 2/1996 | Laubscher | 270/49 |
| 5,520,378 | A | 5/1996 | Kepert et al. | |
| 5,522,586 | A * | 6/1996 | Bennett et al. | 270/8 |
| 5,653,429 | A | 8/1997 | Michalik et al. | 270/49 |
| 5,846,177 | A * | 12/1998 | Mayr | 493/424 |
| 6,179,764 | B1 * | 1/2001 | Eckert | 493/356 |
| 6,358,192 | B1 * | 3/2002 | Michalik | 493/424 |
| 6,367,792 | B1 * | 4/2002 | Chagnon | 270/5.02 |
| 6,616,134 | B2 * | 9/2003 | Maresse et al. | 270/52.09 |
| 6,673,004 | B2 * | 1/2004 | Nanba et al. | 493/428 |
| 6,733,431 | B2 * | 5/2004 | Dufour | 493/428 |
| 2002/0113355 | A1 | 8/2002 | Lange et al. | 270/45 |

FOREIGN PATENT DOCUMENTS

| | | |
|---|---|---|
| DE | 2 025 347 | 6/1971 |
| DE | 25 12 368 | 9/1976 |
| DE | 25 49 761 | 2/1977 |
| DE | 2704813 C2 | 8/1978 |
| DE | 33 02 036 A1 | 7/1984 |
| DE | 3404170 | 8/1985 |
| DE | 43 13 938 | 11/1994 |
| DE | 43 44 622 A1 | 6/1995 |
| EP | 1 013 591 | 6/2000 |
| EP | 1 025-993 | 8/2000 |
| GB | 1 526 013 | 9/1978 |

* cited by examiner

*Primary Examiner*—Christopher R. Hamon
(74) *Attorney, Agent, or Firm*—Cohen Pontani Lieberman & Pavane LLP

(57) ABSTRACT

A variable-circumference folder includes a gathering cylinder fitted with pin systems for reliably holding products of different thickness fed to the gathering cylinder by an accelerating device without any adjustment effort.

13 Claims, 1 Drawing Sheet

From crosscutter
46
48
47
n=2
n=2.75
n=2.75
To gathering cylinder 35
35.1
34
34.1
33
33.1
31
32
28
9
10
3
29
37
23b
22
8
7
2
30
49
CONTROL
27
11
26
12
13
4
14
15
16
20
21
17
19
24 (36)
25
18
23a
1
5
6

VARIABLE-CIRCUMFERENCE FOLDER

BACKGROUND OF THE INVENTION

1. Field of the Invention

The present invention relates to a variable-circumference folder having a gathering cylinder fitted with holding elements and folding blades and an accelerating device for feeding products from a cross-cutting device to the gathering cylinder.

2. Description of the Related Art

U.S. Pat. No. 4,491,310 discloses a variable-circumference folder having a crosscutting device for crosscutting a web stream fed into the folder. The products produced in the process are accelerated by an accelerating device in the form of a conveyor belt and are fed to a gathering cylinder. The gathering cylinder is equipped with grippers which firmly hold the products fed to the gathering cylinder.

A problem with such gripper folders is that the grippers have to be set to the respective product thickness. In addition, during gathering production of products (in particular during multiple gathering), the products are often damaged by the grippers, even though gaps of at least 30 mm are normally already created between the products being fed to the gathering cylinder. Furthermore, it is also possible for the products to be displaced in the circumferential direction in relation to one another on the gathering cylinder (this displacement is referred to as the gathering offset) during gathering production.

SUMMARY OF THE INVENTION

It is an object of the present invention to provide a variable-circumference folder which guides products of different thickness reliably on the gathering cylinder without any adjustment.

According to the present invention, the object is achieved by a variable circumference folder having a gathering cylinder fitted with holding elements and folding blades to which products from a crosscutting device can be fed by an accelerating device in which the holding elements of the gathering cylinder include pin systems. The gathering cylinder reliably pins the products onto the pin systems, irrespective of the thickness of the products. During gathering production, no pin control systems are required for the gathering operation, so that no displacement of the gathered products in relation to one another occurs. Furthermore, the gaps of about 30 mm between each pair of adjacent products in the stream of products being fed to the gathering cylinder which are required when a gripper folder is used are rendered superfluous. Therefore, the acceleration of the products which is used to create the 30 mm gaps may be reduced, thereby increasing the performance of the folder. Overall, the advantages of the pin folding technique are linked with the advantage of variable circumference (variable format), which was previously provided only in gripper folders.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figures 1, 2:
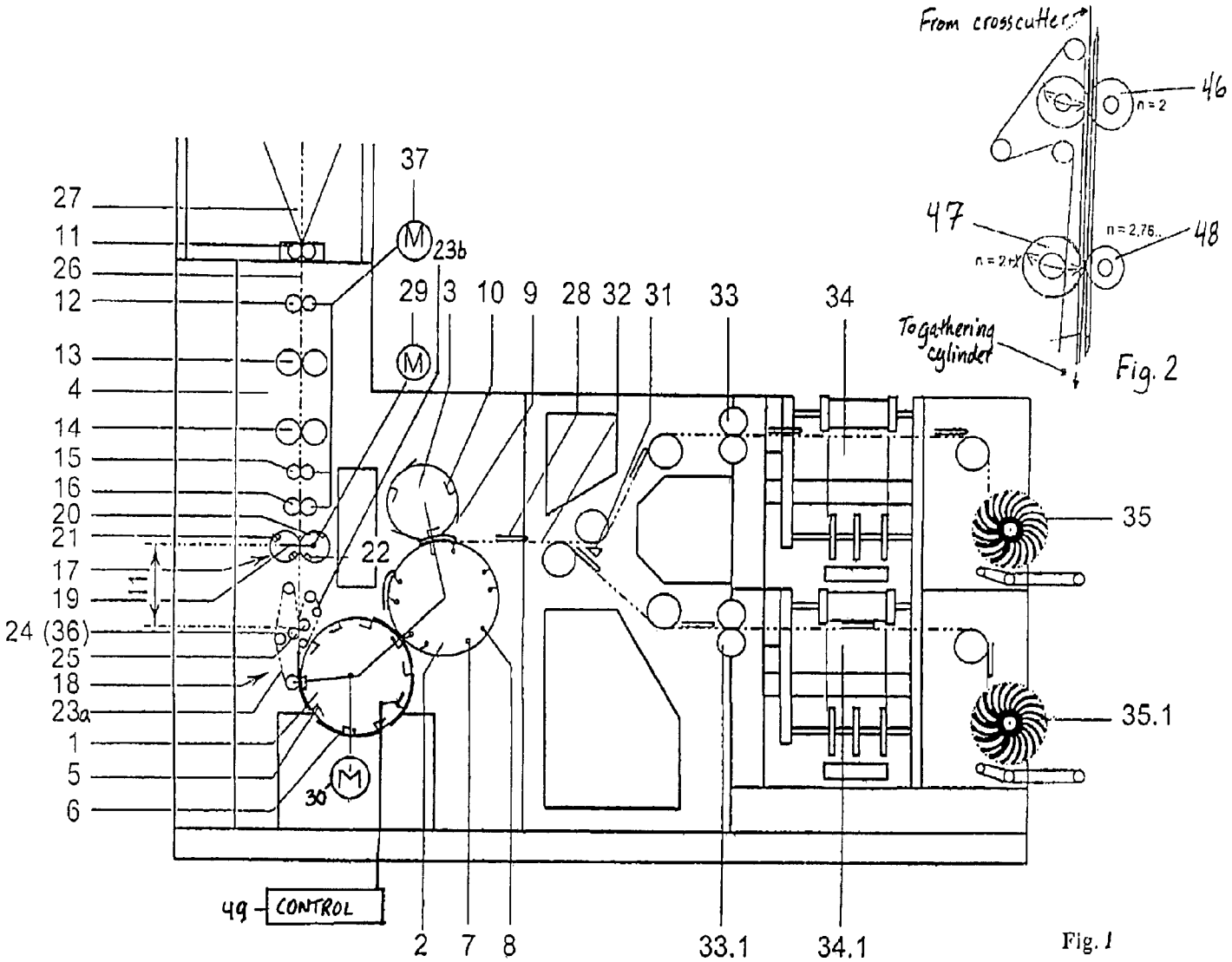
FIG. 1 is a schematic sectional side view of a variable circumference folder according to the present invention.
FIG. 2 is a partial sectional side view of an alternative product clamping device for the folder of FIG. 1.

The variable-circumference folder shown in FIG. 1 has a gathering cylinder 1 which cooperates with a folding-jaw cylinder 2. A second-crossfold cylinder 3 is arranged on the folding-jaw cylinder 2. Each of the gathering cylinder 1, the folding-jaw cylinder 2, and the second-crossfold cylinder 3 are mounted on side walls 4 of the variable-circumference folder. The gathering cylinder 1 is designed in five parts. That is, the gathering cylinder 1 bears five pin systems 5 distributed uniformly on its circumference as holding elements and five folding blades 6. The folding-jaw cylinder 2 is likewise designed in five parts and bears five folding jaws 7 distributed on the circumference for a first crossfold, and five folding jaws 8 for a second crossfold or a delta fold. The second-crossfold cylinder 3 is designed in three parts. That is, the second-crossfold cylinder 3 includes three gripper systems 9 and three folding blades 10 on a circumference thereof.

Inlet rolls 11 are mounted upstream of the gathering cylinder 1 and are followed, relative to a sequence of the web run, by a first pulling device 12, a crossperforating device 13, a longitudinal perforating device 14, an electrostatic charging device 15, a second pulling device 16, a crosscutting device 17 and an accelerating device 18. The first and second pulling devices 12, 16 may, for example, comprise pull rolls and/or rollers. The electrostatic charging device 15 may be formed, for example, by a pair of pull rolls to which the appropriate high voltage is applied, with which the layers in a stream stapled together are caused to form blocks. The first and second pulling devices 12, 16 and the electrostatic charging device 15 are driven jointly by a motor 37 to maintain the required paper tension.

The crosscutting device 17 includes a knife cylinder 19 and a grooved cylinder 20, the knife cylinder 19 being fitted with a cutting knife 21. The grooved cylinder 20 contains a cutting groove 22. The drive for the knife and groove cylinders 19, 20 is advantageously provided by a separate motor 29 to produce, for example, two or three sections for each plate cylinder circumference of a printing machine.

The accelerating device 18 includes a conveyor belts 23*a*, 23*b* which run over rolls 24, 25, respectively, forming a wedge-shaped inlet gap.

A web stream 26 is fed to the variable-circumference folder by a folder structure mounted upstream of the variable-circumference folder and not shown in the drawings. In the embodiment shown in FIG. 1, the web stream 26 fed to the variable-circumference folder is produced following the longitudinal folding in a folding former 27 of one or more webs leaving a printing machine. The folding former 27 may be designed so that it is displaceable longitudinally together with the inlet rolls 11. The web stream 26 may alternatively be fed in by a magazine turner bar structure, not illustrated. After leaving the folding former 27, the web stream 26 passes the inlet rolls 11, the first pulling device 12, the crossperforating device 13, the longitudinal perforating device 14, the electrostatic charging device 15 and the second pulling device 16. As it passes through the crosscutting device 17, the web stream 26 is crosscut to produce the products 28 which run into the wedge-shaped gap of the accelerating device 18. The products 28 are gripped by the rolls 24, 25 or the belts 23*a*, 23*b* running over the rolls, clamped therebetween at clamp position 36, and accelerated to the circumferential speed of the gathering cylinder 1. The clamping means used may alternatively comprise a clamping cam 47 which interacts with a driven roller 48 as shown in FIG. 2. Further, a pulling device 46 may be arranged between the crosscutter and the clamping cam 47. The clamping cam 47 is further described in U.S. Patent Application Publication No. US 2002/0113355, the entire contents of which are incorporated herein by reference.

Referring back to FIG. 1, the distance between the rolls 24, 25 is adjustable to match different product thicknesses. Furthermore, the rolls 24, 25 are arranged at a distance 11 from the crosscutting device 17, which corresponds to the shortest product length. Accordingly, the shortest products can be accelerated without smearing because they are not held in the crosscutting device when they reach the rolls 24, 25.

The speed of the conveyor belts 23*a*, 23*b* is designed for the speed of the maximum cut length. This obviates the need for gaps of about 30 mm between the products 28 which are required for variable gripper folders and allows the acceleration of the accelerating device 18 to be reduced by about 5% compared to the acceleration require for gripper folders which produces about a 5% increase in the performance of the folder. The accelerating device 18, the gathering cylinder 1, the folding-jaw cylinder 2 and the second-crossfold cylinder 3 may be jointly driven by a motor 30 with a variable speed drive to match the cut lengths.

The products 28 fed to the gathering cylinder 1 are reliably pinned onto the gathering cylinder 1 by the pin systems 5, irrespective of the product thickness and the number of gathered sheets. The pin systems do not require any kind of adjustments. That is, the gathering operation of the present invention does not require controls for the pin systems such that no displacement of the gathered products in relation to one another can take place. The pin spacing from the edge of the product 28 may be minimized to 4 mm. Likewise, a short-long cut, which has a doubly detrimental effect in the case of the twofold gathering, is not applicable because a cut does is not follow the gathering cylinder 1. Since in most cases printing marks or control marks are also printed on the products and require a trim of at least 6 mm. Accordingly, the pin insets with 4 mm spacing from the edge are not associated with any disadvantages.

From the gathering cylinder 1, the products 28 are transferred from the pin systems 5 into the folding jaws 7 of the folding-jaw cylinder 2 by the folding blades 6 under control 49 to produce the first crossfold.

The products 28 may then be subjected to further folds using known techniques. For example, a double parallel or delta fold is produced in the embodiment of FIG. 1, by the products 28 being transferred to the gripper systems 9 of the second crossfold cylinder 3 and being pushed into the folding jaws 8 of the folding-jaw cylinder 2 by the folding blades 10. The products 28 with or without the last-described folding, are split by a splitting device 31 and fed by a conveyor belt 32 over retarding devices 33, 33.1 to longitudinal folding devices 34, 34.1 for producing a second longitudinal fold. In addition or alternatively to the longitudinal devices 34, 34.1, the products may be fed to crossfold deliverers 35, 35.1.

The cylinders 19, 20, 1, 2, 3 may also be designed with a number of systems that differ from the embodiment of the Figure, such as cutting knives 21, cutting grooves 22, pin systems 5, folding blades 6, 10, folding jaws 7, 8 and gripper system 9.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements which perform substantially the same function in substantially the same way to achieve the same results are within the scope of the invention. Moreover, it should be recognized that structures and/or elements shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

What is claimed is:

1. A variable-circumference folder having a crosscutting device for receiving a web stream and producing cut products, a gathering cylinder fitted with holding elements and folding blades, an accelerating device receiving the products from said crosscutting device and feeding the products to said gathering cylinder, wherein said accelerating device comprises clamping means for gripping the products, said clamping means being arranged at a product length distance from the crosscutting device which corresponds to the shortest product length of the products, wherein said holding elements of said gathering cylinder comprise non-adjustable pin systems, each of said pin systems being arranged and dimensioned for gathering and holding a set of the products by pinning a plurality of products onto said each of said pin systems, and a crossfold cylinder arranged downstream of said gathering cylinder having a gripper system, said crossfold cylinder being arranged and dimensioned for receiving said gathered set of the products in said gripper system and folding said gathered set of the products.

2. The variable-circumference folder of claim 1, wherein said clamping means comprise rolls and belts guided over said rolls for forming a wedge-shaped inlet gap therebetween.

3. The variable-circumference folder of claim 1, wherein said clamping means comprise a clamping cam.

4. The variable-circumference folder of claim 1, further comprising an electrostatic charging device arranged upstream of said crosscutting device relative to a direction of said web stream.

5. The variable-circumference folder of claim 1, further comprising a folding-jaw cylinder arranged on said gathering cylinder and upstream of said crossfold cylinder.

6. The variable-circumference folder of claim 4, further comprising a folding-jaw cylinder arranged on said gathering cylinder and upstream of said crossfold cylinder.

7. The variable-circumference folder of claim 1, wherein said accelerating device is operated at the speed of the products with maximum cut lengths.

8. The variable-circumference folder of claim 1, further comprising a first motor for jointly driving said accelerating device and said gathering cylinder.

9. The variable-circumference folder of claim 1, further comprising a motor dedicated to driving said crosscutting device.

10. The variable-circumference folder of claim 8, further comprising a second motor dedicated to driving said cross-cutting device.

11. The variable-circumference folder of claim 1, wherein said gathering cylinder has five of said pin systems and said cross fold cylinder has three gripper systems.

12. The variable-circumference folder of claim 5, wherein said folding jaw cylinder comprises folding jaws arranged and dimensioned for receiving the gathered set of the products from said pin systems of said gathering cylinder and forming a crossfold in the gathered set of the products, and wherein said cross fold cylinder is arranged and dimensioned for forming one of a double parallel or a delta fold in addition to said crossfold.

13. The variable-circumference folder of claim 12, wherein said gathering cylinder has five of said pin systems, said folding jaw cylinder has five of said folding jaws, and said cross fold cylinder has three gripper systems.

* * * * *